US005883603A

United States Patent [19]

Kim

[11] Patent Number: 5,883,603

[45] Date of Patent: Mar. 16, 1999

[54] METHOD FOR ADJUSTING RADIATION DIRECTION OF ANTENNA

[75] Inventor: Hong Seok Kim, Inchon, Rep. of Korea

[73] Assignee: Hyundai Electronics Industries Co. Ltd., Rep. of Korea

[21] Appl. No.: 918,225

[22] Filed: Aug. 25, 1997

[30] Foreign Application Priority Data

Sep. 9, 1996 [KR] Rep. of Korea ..... 1996 38923

[51] Int. Cl.[6] ..... H01Q 13/00

[52] U.S. Cl. ..... 343/785; 343/772; 333/238

[58] Field of Search ..... 343/785, 786, 343/772, 767, 783, 754; 333/238; H01Q 13/00, 13/20, 13/24, 13/26

[56] References Cited

U.S. PATENT DOCUMENTS 4,689,584 8/1987 Sequeira ..... 343/785
4,835,543 5/1989 Sequeira ..... 343/785
5,237,334 8/1993 Waters ..... 343/753
5,652,596 7/1997 Abrahams et al. ..... 343/753

*Primary Examiner*—Don Wong
*Assistant Examiner*—Tan Ho
*Attorney, Agent, or Firm*—Fish & Richardson P.C.

[57] ABSTRACT

A method for adjusting the radiation direction of an antenna, which uses a plurality of uniformly spaced diffraction gratings formed in the waveguide of the antenna while adjusting the maximum radiation direction of radiation waves emerging from the diffraction gratings and varying the length of crystal lattices in the diffraction gratings, thereby achieving an improvement in the directivity of the radiation waves and an adjustment in the radiation direction of radiation waves. In accordance with this method, it is possible to vary the radiation direction of an electronic wave passing through the antenna by varying the interval of crystal lattices in a region where the diffraction gratings exist. Accordingly, it is possible to obtain a narrow beam width characteristic. The diffraction gratings are made of a piezo-electric material. Using the characteristic of such a piezo-electric material, it is possible to vary the interval of crystal lattices in the diffraction grating region in an electrical manner, thereby adjusting the radiation direction of beams.

1 Claim, 2 Drawing Sheets

σ: REFRACTIVE INDEX

σ: REFRACTIVE INDEX

METHOD FOR ADJUSTING RADIATION DIRECTION OF ANTENNA

BACKGROUND OF THE INVENTION

1. Field of the Invention

The present invention relates to a method for adjusting the maximum radiation direction of a radiation wave by use of diffraction gratings formed on the surface of a dielectric waveguide, and more particularly to a method for adjusting the radiation direction of radiation waves in an antenna, which uses a plurality of uniformly spaced diffraction gratings formed in the waveguide of the antenna while applying voltage to the diffraction gratings to vary the length of crystal lattices in the diffraction gratings, thereby achieving an improvement in the directivity of the radiation waves and an adjustment in the radiation direction of radiation waves.

2. Description of the Prior Art

Generally, antennas are conductors installed in the air to radiate or absorb electric waves. Such antennas are classified into those for the purpose of transmission and those for the purpose of reception in terms of their use purposes. In terms of the wavelength of an electric wave used, such antennas are also classified into those for medium frequency wave, those for short wave, and those for very high frequency wave. These antennas of different types have different operating principles and configurations, respectively. Such antennas are also classified into directional antennas and non-directional antennas in accordance with the radiation characteristic of an electric wave used. Also, such antennas have a variety of shapes, for example, I, T, and inverted-L shapes, etc.

FIG. 1 is a sectional view illustrating an antenna system which uses a dielectric waveguide having a conventional travelling-wave antenna configuration. The antenna system includes a tuning stub 1 arranged at the intermediate portion of the waveguide. The tuning stub 1 serves as a short circuit plate for matching a coaxial feed line 2 with a load. The coaxial feed line 2 consists of a coaxial cable and extends through the waveguide. The coaxial feed line 2 connects the antenna to a transmitter or receiver to feed electric power therebetween. The waveguide, which is denoted by the reference numeral 3, is a circular metal tubing waveguide having a hollow circular metal tube construction and serving as a high-pass filter. That is, the circular metal tubing waveguide 3 has a certain cut-off wavelength in a guide mode so that it prevents waves having a wavelength longer than the cut-off wavelength from passing therethrough. The waveguide 3 carries out a propagation at a guide wavelength different from an excitation wavelength therein. A polystyrene material, which is a typical material for antennas, fills the interior of the circular metal tubing waveguide 3. The polystyrene member 4 protrudes outwardly from the circular metal tubing wave guide 3.

In this antenna configuration, transmission/reception microwaves are axially input/output through the circuit metal tubing waveguide 3. The tuning stub 1 matches the circular metal tubing waveguide 3 with the coaxial feed line 2 serving as an electric power passage between the transmitter/receiver and the antenna. The circular metal tubing waveguide 3, the coaxial feed line 2, the end portion of the waveguide and the protruded portion of the polystyrene member 4 are set by different wavelengths, respectively, to obtain a travel of waves of appropriate wavelengths for a transmission of microwaves.

In such a conventional antenna, however, the travel direction of radiation waves coincides with the extension direction of the antenna. Furthermore, this antenna exhibits a degradation in directivity because the width of waves passing through the antenna is widened. Also, the dielectric system should use a phase modulator for adjusting the direction of radiation waves. As a result, the entire system is bulky. It is also impossible for the system to be used for millimeter waves having a high frequency and in the optical wave frequency band.

U.S. Pat. No. 5,237,334 (William M. Waters) discloses a focal plane antenna array for millimeter waves. The millimeter-wave focal plane antenna array comprises a means defining a planar array of a plurality of open ended waveguides which, in use, are disposed at the focal plane, and a microstrip detector means coupled to the waveguides for detecting the millimeter wave radiation received thereby. The microstrip detector means comprises a dielectric substrate affixed to the array defining means, and a plurality of separate, unconnected microstrip conductors embedded in the substrate. Each microstrip conductor is coupled to a respective one of the waveguides to receive the millimeter radiation therefrom. The microstrip detector means also comprises a diode detector being connected to each microstrip conductor for producing an output in accordance with the millimeter wave radiation coupled from a corresponding waveguide to the associated microstrip conductor. The millimeter-wave focal plane antenna array uses a plate made of a conductive material to adjust the direction of radiation waves. However, since the plate has a perforated structure, it is difficult for the plate to have a reduced thickness for its low-frequency use.

SUMMARY OF THE INVENTION

Therefore, an object of the invention is to solve the above-mentioned problems involved in the prior art and to provide a method for adjusting the radiation direction of an antenna, which uses a plurality of uniformly spaced diffraction gratings formed in the waveguide of the antenna while adjusting the maximum radiation direction of radiation waves emerging from the diffraction gratings and varying the length of crystal lattices in the diffraction gratings, thereby achieving an improvement in the directivity of the radiation waves and an adjustment in the radiation direction of radiation waves.

In accordance with the present invention, this object is accomplished by providing a method for adjusting the radiation direction of an antenna, comprising the steps of: machining a surface of the antenna to form a diffraction grating at a waveguide region of the antenna, thereby forming a radiation mode region having non-uniform dielectric constant and refractive index distributions along the travel direction of an electronic wave passing through the waveguide region; coupling electrodes to opposite ends of the radiation mode region, respectively, and applying a voltage to the electrodes; and varying the voltage applied to the electrodes, thereby varying the length of crystal lattices in the radiation mode region, whereby the direction of a radiation wave emerging from the antenna is adjusted to a desired direction.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
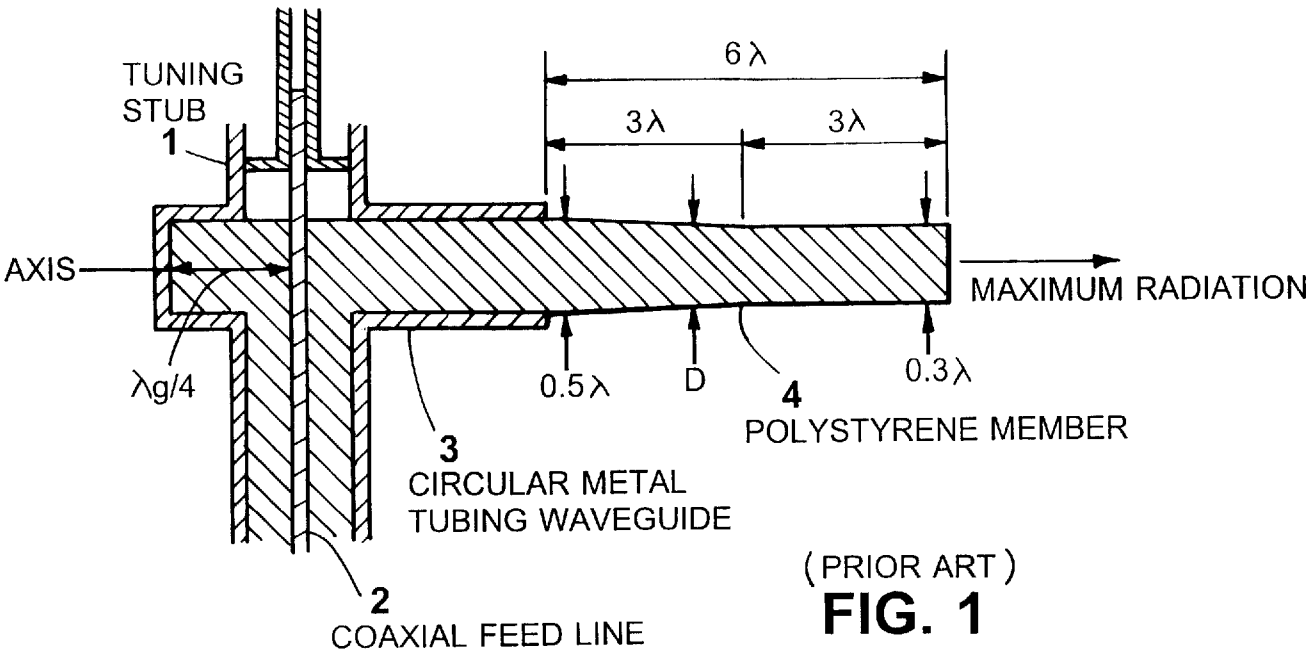
(PRIOR ART) FIG. 1
FIG. 1 is a sectional view illustrating an antenna system which uses a dielectric waveguide having a conventional travelling-wave antenna configuration.
Figure 2A:
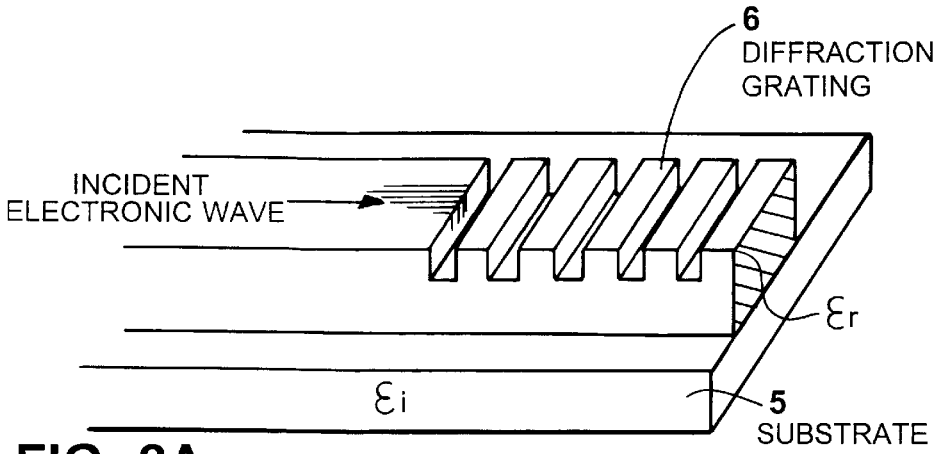
FIG. 2*a* is a perspective view illustrating the waveguide of a dielectric antenna according to an embodiment of the present invention.
Figure 2B:
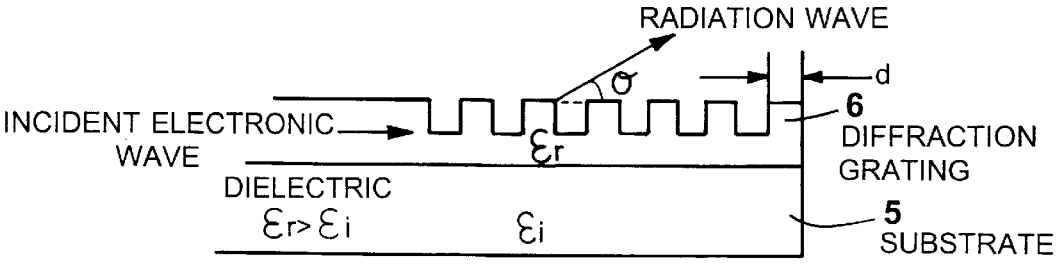
FIG. 2*b* is a side view illustrating a radiation mode established in the dielectric waveguide shown in FIG. 2*a*.
Figure 2C:
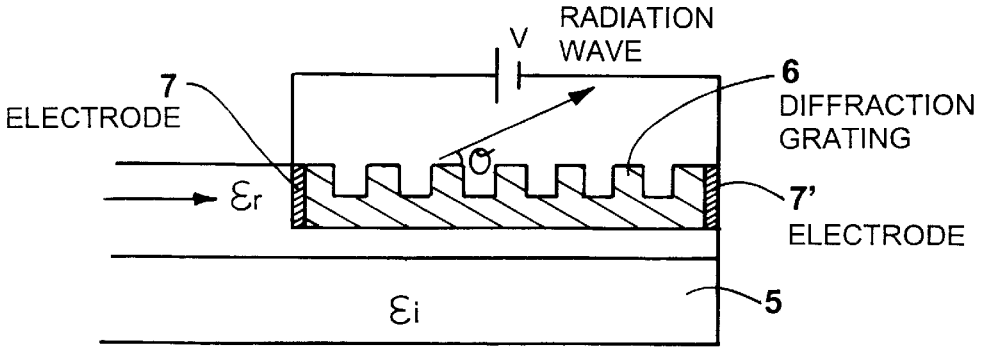
FIG. 2*c* is a sectional view illustrating a diffraction grating portion of the waveguide made of a piezo-electric material.

Referring to FIGS. 2*a* to 2*c*, an antenna having a configuration according to the present invention is illustrated. As shown in FIG. 2*a*, the antenna comprises a substrate 5, and a waveguide formed over the substrate. The waveguide has a plurality of uniformly spaced diffraction gratings 6 at a desired portion thereof. The diffraction gratings 6 serve to provide non-uniform dielectric constant and refractive index distributions along the travel direction of electronic waves passing through the antenna so that an electronic wave incident on the antenna radiates outwardly from the antenna when it reaches a certain position in a diffraction grating region where the diffraction gratings exist. The diffraction gratings are made of a piezo-electric material such as quartz or ceramic. The antenna also comprises a pair of electrodes 7 and 7' respectively attached to opposite lateral ends of the diffraction grating region to apply a desired voltage to the diffraction grating region. The length of crystal lattices in the diffraction grating region varies in accordance with the voltage applied to the diffraction grating region, so that the radiation direction of radiation waves passing through the antenna varies.

Now, the operation of the antenna having the above-mentioned configuration according to the present invention will be described.

When an electronic wave incident on the waveguide of the antenna reaches the diffraction grating region formed with the diffraction gratings 6, only the basic-mode component, namely, the lowest-frequency component, of the electronic wave travels along the waveguide in accordance with an appropriately selected dielectric constant $\in_r$ or thickness d of the dielectric waveguide. At this time, the electronic wave reaching the diffraction grating region takes a radiation mode, in which the electronic wave radiates outwardly, in accordance with the non-uniform dielectric constant and refractive index distributions along the travel direction of the electronic wave. Accordingly, the incident electronic wave radiates outwardly.

Thus, the radiation direction of radiation waves can be optionally determined in accordance with the interval of crystal lattices in the diffraction grating region and the propagation constant in the radiation mode wave travel direction.

FIG. 2*c* is a side view illustrating the diffraction gratings of the antenna made of a piezo-electric material such as quartz or ceramic. When voltage is applied to the piezo-electric material of the diffraction gratings, the crystal lattices of the piezo-electric material vary in the lattice length in accordance with the applied voltage. By virtue of such a variation in the lattice length, the radiation direction of the incident electronic wave varies. Thus, the radiation direction of radiation waves can be adjusted to a desired direction.

Although the preferred embodiments of the invention have been disclosed for illustrative purposes, those skilled in the art will appreciate that various modifications, additions and substitutions are possible, without departing from the scope and spirit of the invention as disclosed in the accompanying claims. For example, the dielectric constant and refractive index of the waveguide can be optionally determined. The size and interval of the diffraction gratings may also be optionally selected.

As apparent from the above description, the present invention provides a method for adjusting the radiation direction of an antenna, which uses a plurality of uniformly spaced diffraction gratings formed in the waveguide of the antenna. In accordance with this method, it is possible to vary the radiation direction of an electronic wave passing through the antenna by varying the interval of crystal lattices in a region where the diffraction gratings exist. Accordingly, it is possible to obtain a narrow beam width characteristic. The diffraction gratings are made of a piezo-electric material. Using the characteristic of such a piezo-electric material, it is possible to vary the interval of crystal lattices in the diffraction grating region in an electrical manner, thereby adjusting the radiation direction of beams. Such an effect can be achieved using a simple configuration.

What is claimed is:

1. A method for adjusting the radiation direction of an antenna, comprising the steps of:

machining a surface of the antenna to form a diffraction grating at a waveguide region of the antenna, thereby forming a radiation mode region having non-uniform dielectric constant and refractive index distributions along the travel direction of an electronic wave passing through the waveguide region;

coupling electrodes to opposite ends of the radiation mode region, respectively, and applying a voltage to the electrodes; and varying the voltage applied to the electrodes, thereby varying the length of crystal lattices in the radiation mode region, whereby the direction of a radiation wave emerging from the antenna is adjusted to a desired direction.

* * * * *